US006070965A

United States Patent [19]

Fujimoto

[11] Patent Number: 6,070,965

[45] Date of Patent: Jun. 6, 2000

[54] INK JET PRINTHEAD WITH FOLDED FLEXIBLE CORD, AND NOZZLE PLATE USED FOR THE SAME

[75] Inventor: Hisayoshi Fujimoto, Kyoto, Japan

[73] Assignee: Rohm Co., Ltd., Kyoto, Japan

[21] Appl. No.: 08/817,917

[22] PCT Filed: Oct. 26, 1995

[86] PCT No.: PCT/JP95/02207

§ 371 Date: Apr. 25, 1997

§ 102(e) Date: Apr. 25, 1997

[87] PCT Pub. No.: WO96/13388

PCT Pub. Date: May 9, 1996

[30] Foreign Application Priority Data

| | | | |
|---|---|---|---|
| Oct. 28, 1994 | [JP] | Japan | 6-265174 |
| Feb. 28, 1995 | [JP] | Japan | 7-039828 |
| May 1, 1995 | [JP] | Japan | 7-107577 |

[51] Int. Cl.[7] ..... B41J 2/14

[52] U.S. Cl. ..... 347/50

[58] Field of Search ..... 347/50, 49, 48, 347/47, 40, 44, 68, 71, 72, 32

[56] References Cited

U.S. PATENT DOCUMENTS

| | | | |
|---|---|---|---|
| 4,392,145 | 7/1983 | Parkola . | |
| 4,605,939 | 8/1986 | Hubbard et al. . | |
| 4,703,333 | 10/1987 | Hubbard . | |
| 4,752,789 | 6/1988 | Maltsev . | |
| 4,755,836 | 7/1988 | Ta et al. | 347/37 |
| 5,600,354 | 2/1997 | Hackleman et al. | 347/50 |

FOREIGN PATENT DOCUMENTS

| | | | |
|---|---|---|---|
| 0615844 A1 | 9/1994 | European Pat. Off. | B41J 2/155 |
| 59-19161 | 1/1984 | Japan | B41J 3/00 |
| 6-297715 | 10/1994 | Japan | B41J 2/05 |

*Primary Examiner*—N. Le
*Assistant Examiner*—Thien Tran
*Attorney, Agent, or Firm*—Michael D. Bednarek; Crowell & Moring LLP

[57] ABSTRACT

An ink jet printhead of the present invention includes a plurality of printhead elements (1) each having a plurality of ink injecting holes (10), a flat flexible cord (2) electrically connected to the respective printhead elements (1), and ink distributing member (5) to supply the respective printhead elements (1) with ink. Each printhead element (1) has a head element body (11) made of a resin material, and the head element body (11) has a front wall portion **(1*a*) in which the plurality of ink injecting holes (11) are formed. The head element body has side surfaces (11*a*) formed with a plurality of dented groove-shaped ink passageways communicating with the respective ink injecting holes (10), and each side surface supports a diaphragm (12) carrying a plurality of piezoelectric elements (13) corresponding to the respective ink passageways. The flexible cord (2) is inserted between neighboring printhead elements (1) and provided with a conductive wiring pattern (22) having output terminals (25) electrically connected to the piezoelectric elements (13) of the respective printhead elements (1)**.

14 Claims, 10 Drawing Sheets

INK JET PRINTHEAD WITH FOLDED FLEXIBLE CORD, AND NOZZLE PLATE USED FOR THE SAME

TECHNICAL FIELD

The present invention relates to an ink jet printhead used for a printing unit of a printer, a facsimile machine, a plotter and the like. The present invention also relates to a nozzle plate used for such a printhead.

BACKGROUND ART

Among ink jet printheads of the above type, there is an example shown in FIG. 17 which is already known. In this conventional ink jet printhead, the glass plate 70 as a head substrate has a lower surface provided with a plurality of dented groove-shaped ink passageways 71 (only one passageway is shown for convenience of illustration) which are formed by etching. A lower opening 71*a* of each ink passageway 71 is closed by a diaphragm 80. The diaphragm 80 includes a thin glass plate 81 capable of deflecting and has a lower surface formed with a conductive layer 82 such as an ITO layer (tin oxide layer containing a small amount of additives, or indium oxide layer containing tin oxide). The conductive layer carries a piezoelectric element 83 attached thereto.

With such an arrangement, when voltage is supplied to the piezoelectric element 83, the thin glass plate 81 deflects concavely into the ink passageway 71, as shown by arrow a in FIG. 17. As a result, the volume of the ink passageway 71 is instantly reduced to inject the ink contained in the ink passageway 71 from a nozzle bore 84.

However, in the conventional ink jet printhead, the head substrate 70 is made of a glass plate 70 as is the diaphragm 80, and the dented groove-shaped ink passageway 71 is made by an etching process, thereby rendering the etching process to be very difficult to perform. Further, for the purposes of processing the glass plate 70 to have predetermined outer dimensions, there may be necessary to perform a sand-blasting operation for example, which will require cleaning in a later process. Further, the glass plate 70 is susceptible to a damage such as cracking, thereby requiring delicate handling. Therefore, with the conventional ink jet printhead, the manufacturing processes are very complicated, the production efficiency is low, so that there exists an inherent problem of incurring cost increase.

On the other hand, high density printing is needed also in the field of ink jet printheads. For realizing high density printing with the conventional ink jet printhead shown in FIG. 17, it is necessary to increase the disposition density of the ink passageways 71 as well as, accordingly, the disposition density of the piezoelectric elements 83 mounted on the diaphragm. Thus, it becomes very difficult to separately perform a wiring operation to each of the piezoelectric elements disposed with a high density so that power is supplied. In addition to the problem that the connecting operation of wires performed to each of a great number of piezoelectric elements becomes troublesome, it will be required to ensure a larger spacing for performing the wiring operation to prevent the wires for many piezoelectric elements from interfering with each other. As a result, with the conventional ink jet printhead, due to the difficulty of providing electrical connection, the printhead as a whole has to be increased in size to overcome the problem, while the production process becomes disadvantageously complicated, thereby resulting in cost increase.

Particularly, in a color ink jet printhead, a plurality of printheads are to be juxtaposed for separately injecting different color inks such as cyanogen, magenta, yellow, black and the like.

In such a printhead, if the above described arrangement of the conventional printhead is adopted, the wiring arrangement for the respective printheads become complicated as described above. Further, the wiring arrangement will disadvantageously become much more complicated, since it is necessary to unite the wirings of the respective printheads at a certain point for electrical connection to a desired control circuit.

DISCLOSURE OF THE INVENTION

Therefore, an object of the present invention is to provide an ink jet printhead which can be produced with a high efficiency and a low cost by a simple production method, without performing a complicated production operation such as etching treatment for example.

Another object of the present invention is to provide an ink jet printhead with which a wiring connection to each piezoelectric element is performed without requiring a large spacing, so that reduction in size and simplification of manufacturing process are realized even when a higher printing density is required.

Still another object of the present invention is to provide a nozzle plate which is advantageously used for such an ink jet printhead.

According to a first aspect of the present invention, there is provided an ink jet printhead comprising a plurality of printhead elements each having a plurality of ink injecting holes, a flat flexible cord electrically connected to the respective printhead elements, and ink providing means for providing the respective printhead elements with ink. Each printhead element includes a head element body of a resin material, and the head element body has a front wall portion provided with the plurality of ink injecting holes. The head element body has at least one side surface formed with a plurality of dented groove-shaped ink passageways communicating with the respective ink injecting holes. A diaphragm which carries a plurality of piezoelectric elements in correspondence with the respective ink passageways is attached to the side surface of the head element body. The plurality of printhead elements are laminated so that the respective front wall portions thereof are rendered to face in a same direction. The flexible cord is inserted between adjacent printhead elements and provided with a conductive wiring pattern having output terminals electrically connected to the piezoelectric elements of the respective printhead elements.

With such an arrangement, since each head element body is made of resin, the ink injecting holes and the ink passageways can be simultaneously formed by using dies. Thus, since there is no need to perform a complicated process such as etching for example, the production processes of the printhead is remarkably simplified, and the costs are reduced. Further, unlike an instance where the head element body is made of glass, since there is no suffering from a damage by an impulsive force, handling performance during a producing process is improved, and final adjustment of e.g. outside dimensions does not require any complicated operation such as sand-blasting. Thus, the simplification of the printhead production and the reduction in costs are remarkably promoted.

Further, since the printhead is constituted by a plurality of printhead elements in lamination, printing density can be improved by increasing the total number of the ink injecting holes (that is, printing dots). In such an instance, the number of the ink injecting holes and the pitch for arranging the ink passageways and piezoelectric elements can be suitably determined.

Therefore, even when there are limits to processing accuracy in integrally making the head element body from resin, the influence due to the limits can be minimized so that the printing density of the printhead as a whole is advantageously increased.

On the other hand, the flat flexible cord is held between adjacent printhead elements so that electrical connection to the piezoelectric elements of each print head element can be suitably performed. Thus, the printhead can be reduced in size since the flexible cord is compactly accommodated between the respective printhead elements.

According to a preferred embodiment of the present invention, the flexible cord is alternately folded in opposite directions and inserted at every other folded portion between adjacent printhead elements. With such an arrangement, electrical wiring connection to the plurality of printhead elements can be performed by a single flexible cord. Therefore, even when a larger number of printhead elements are used to increase the number of the printing dots, there is no need to enlarge the spacing for accommodating the flexible cord, and no need to worry about entangled flexible cords. This is especially advantageous in using the printhead to perform color printing.

Each ink passageway of the head element body may have a front end formed with a step portion which is deeper than the ink passageway so that the ink passageway communicates with a corresponding ink injecting hole via the step portion. With such an arrangement, in making the head element body from resin by using dies, the ink passageways in a side surface of the head element body and the ink injecting holes in the front wall portion of the head element body are simultaneously formed while they properly communicate with each other.

Each ink passageway of the head element body may have a rear end formed with projections to partially strangulate the ink passageway. With this arrangement, bubble generation can be restricted.

The head element body may have a rear wall portion provided with an ink inlet communicating with the respective ink passageways. The ink inlet can be formed simultaneously together with the ink passageways in the side surface of the head element body and the ink injecting holes of the front wall portion.

The ink providing means may be attached to a rear wall portion of the head element body and serve as an ink distributing member having ink providing passages communicating with the respective ink passageways. With such an arrangement, there is no need to give ink to each printhead element separately. Instead, the ink supplying can be collectively performed with the use of a single ink distributing member so that the entire arrangement of the ink jet printhead is simplified.

The ink injecting holes may be arranged in at least one row for each printhead element, and the row of the ink injecting holes in each printhead element may be advantageously offset in a direction of the row of the ink injecting holes by a predetermined pitch relative to a row of the ink injecting holes in an adjacent printhead element. With such an arrangement, the density of the printing dots can be improved to provide printing images of better quality. Alternately, a similar advantage is obtainable by arranging the ink injecting holes into two rows for each printhead element, and rendering the two rows of the ink injecting holes in each printhead element to be offset relative to each other in a direction of the rows of the ink injecting holes by a predetermined pitch.

Further, the ink injecting holes in each printhead element may be advantageously formed separately into a first row of ink injecting holes and a second row of ink injecting holes, where the two rows are spaced from each other by a minimum pitch and where the second row of ink injecting holes in each printhead element is spaced from a first row of ink injecting holes in an adjacent printhead element by a pitch which is an integral multiple of the minimum pitch. With such an arrangement, the printing dots of the plurality of printhead elements can be regularly disposed. As a result, a controlling operation to print out desired images can be easily performed. Thus, desired printing-out is easily obtained by a same controlling manner as is performed with an ink jet printhead including only one conventional printhead element.

Further, it is preferable that a nozzle plate is attached to the plurality of printhead elements at front portions thereof, and that the nozzle plate is formed with minute nozzle holes arranged correspondingly to the ink injecting holes. With such an arrangement, even if the diameter and position of the ink injecting holes of the respective head element bodies are not so accurately prepared, desired printing quality is obtained by accurately setting the diameter and position of the respective nozzle bores of the nozzle plate. As a result, in forming the head element body integrally from resin, certain degrees of deviation in terms of the size and position of the ink injecting holes can be regarded as permissible, so that the production is facilitated to remarkably contribute to reduction in the production costs.

According to a second aspect of the present invention, there is provided a nozzle plate attached to the front wall portion of the ink jet print head which includes a plurality of printhead elements in lamination each of which has a plurality of ink injecting holes in the front wall portion. The nozzle plate is characterized in having deviation absorbing means which defines a plurality of regions corresponding to the respective printhead elements and allows each region to independently move perpendicularly to a surface of the nozzle plate.

With such an arrangement, even if the front wall portions of the respective printhead elements in lamination fail to be contained exactly in a common plane and are slightly deviated in a direction perpendicular to a plane of the nozzle plate, the deviation can be absorbed by displacement of each defined region of the nozzle plate. Thus, the assembly operation of the printhead elements is facilitated. Further, since the front wall portion of each printhead element is closely engaged with a corresponding defined region of the nozzle plate, the injection of ink jet can be equally performed with all the printhead elements.

The deviation absorbing means may include slits which uncontinuously surround the respective regions defined in the nozzle plate, or alternately they may include grooves which substantially surround the respective regions defined in the nozzle plate.

Other objects, features and advantages of the present invention will be clearer from the embodiments described below with reference to the accompanying drawings.

BEST MODE FOR CARRYING OUT THE INVENTION

Preferred embodiments of the present invention will be described below with reference to the accompanying drawings.

Figure 1:
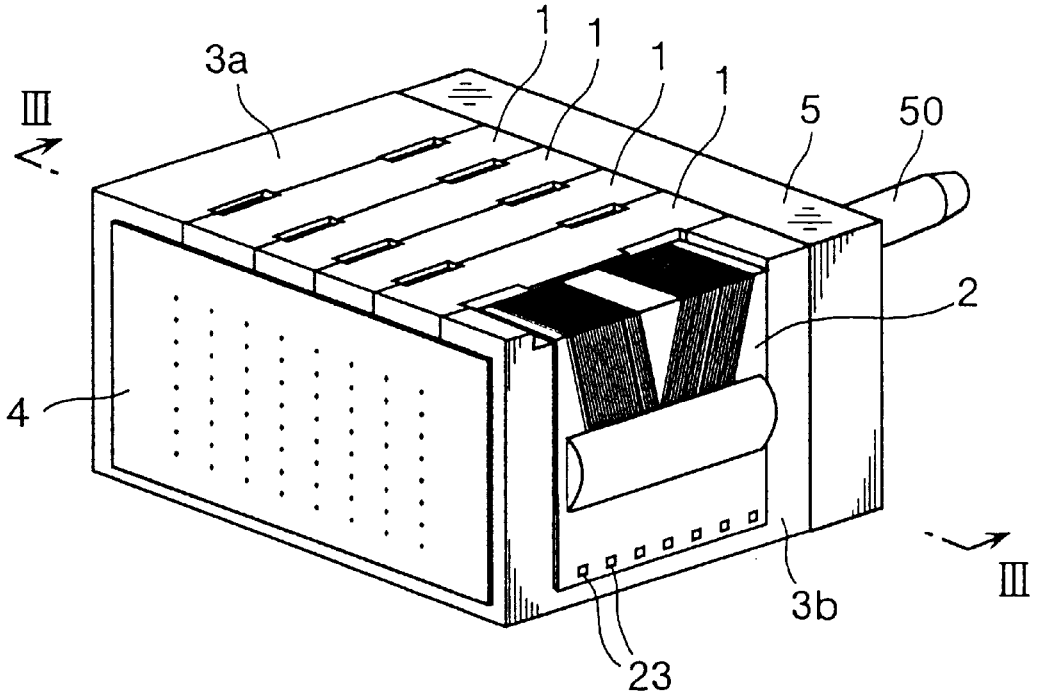
FIG. 1 is a perspective view showing an ink jet printhead according to a first embodiment of the present invention.
Figure 3:
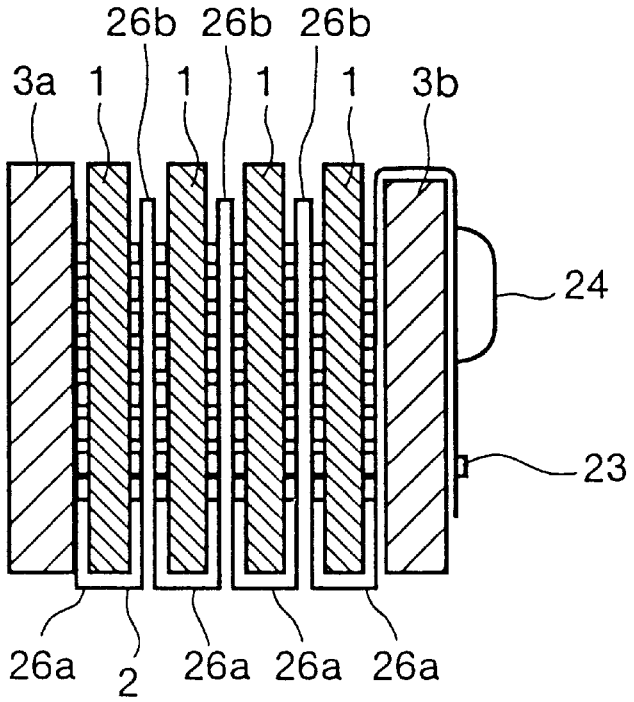
FIG. 3 is a sectional view which is taken along lines III—III in FIG. 1.
Figure 2:
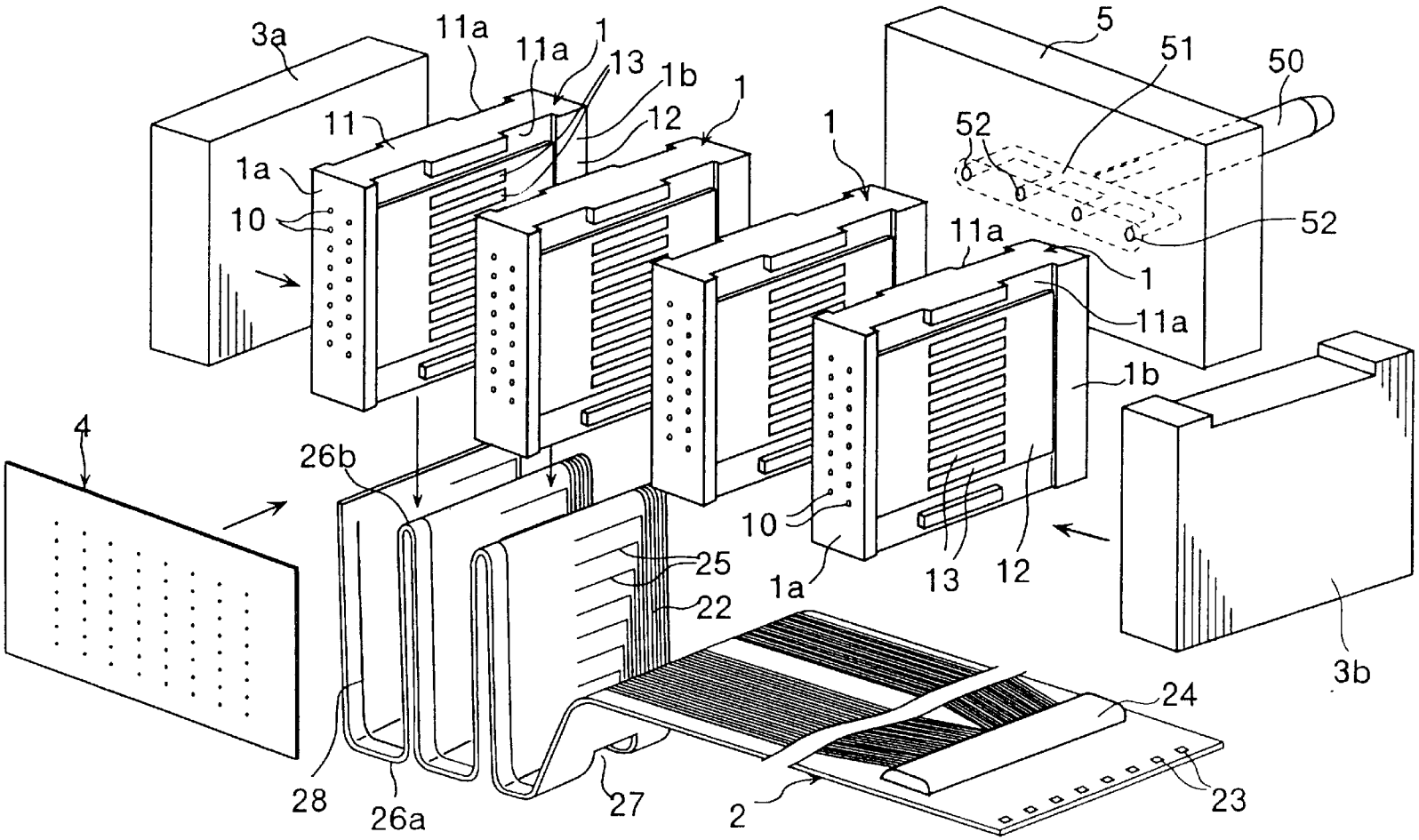
FIG. 2 is an exploded perspective view of the ink jet printhead illustrated in FIG. 1.

FIGS. 1–3 illustrate the entirety of an ink jet print head according to a first embodiment of the present invention. Of these drawings, FIG. 1 is a perspective view of the same printhead, and FIG. 2 is an exploded perspective view of the same printhead. FIG. 3 is a sectional view taken along lines III—III in FIG. 1.

Basically, the ink jet printhead illustrated in FIGS. 1–3 includes a plurality of printhead elements 1, a flat flexible cord 2 held between the respective printhead elements 1, a pair of clamp members 3*a*, 3*b* to unite all the printhead elements, a nozzle plate 4 and an ink distributing member 5. These structural parts will be described hereinafter.

As shown in FIG. 2, each printhead element 1 includes a head element body 11 made of a synthetic resin material having good chemical resistance, such as polysulfone for example. The head element body 11 has a front wall portion 1*a* and a rear wall portion 1*b*. The front wall portion 1*a* of the head element body 11 is formed with a plurality of ink injecting holes 10 for ink injection. The head element body 11 has side surfaces 11*a* to which diaphragms 12 are attached. Each diaphragm 12 carries a plurality of piezoelectric elements 13 attached thereto.

Figure 4:
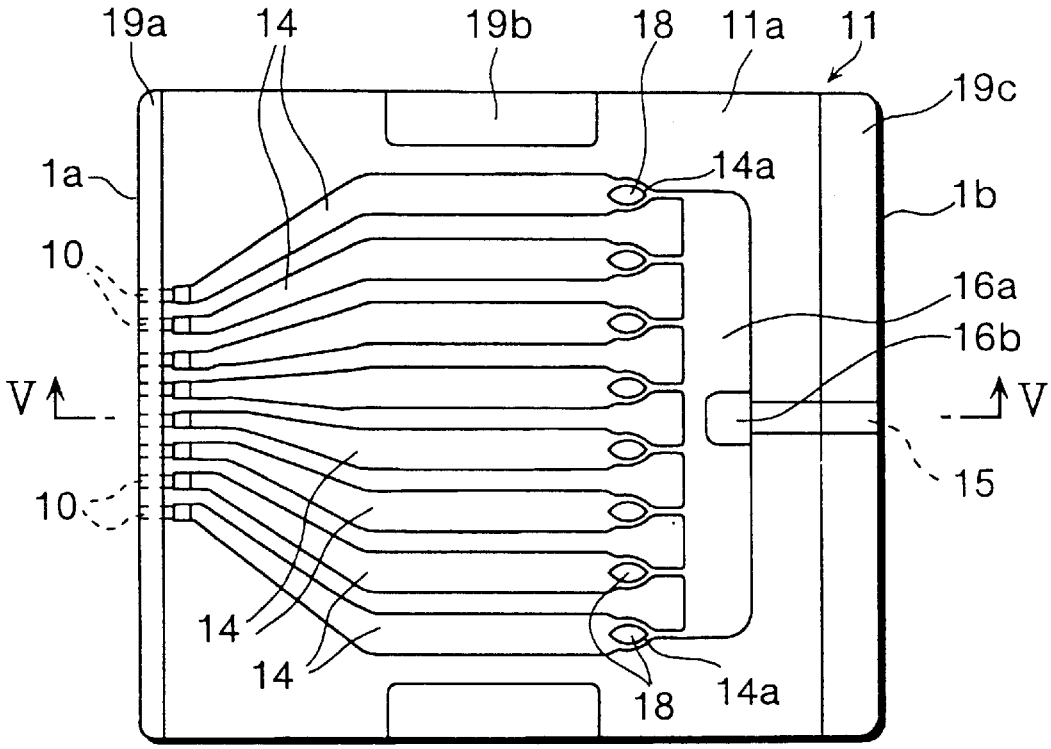
FIG. 4 is a side view showing a head element body for constituting a printhead element used for the ink jet printhead illustrated in FIG. 1.
Figure 5:
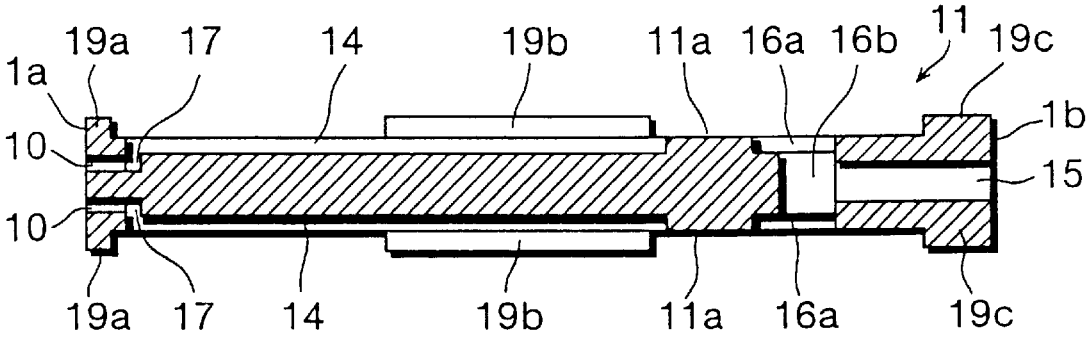
FIG. 5 is a sectional view taken along lines V—V in FIG. 4.
Figure 6:
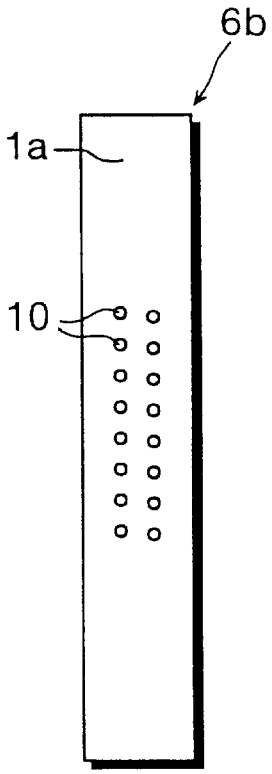
FIG. 6 is a front view of the head element body illustrated in FIG. 4.

As shown in FIGS. 4–6, the respective side surfaces 11*a* of the head element body are formed with a plurality of dented groove-shaped separate ink passageways 14. Each ink passageway 14 has a front end portion communicating with a groove 16*a* formed in a respective side surface 11*a*. The groove 16*a* communicates via a traverse port 16*b* with an ink inlet 15 formed in the rear wall portion 1*b* of the printhead body 11. Further, each ink passageway 14 has a rear end formed with a dented step portion 17 which is deeper than the ink passageway 14. The step portion 17 communicates with a corresponding ink injecting hole 10. As a result, ink introduced via the ink inlet 15 is caused to flow through the respective ink passageways 14 and then out of the corresponding ink injecting holes 10.

In this embodiment, as shown in FIG. 4, the rear end portion of each ink passageway 14 is formed with a projection 18 reaching the level of the corresponding side surface 11*a* of the head element body 11. As a result, each ink passageway 14 is rendered to have a pair of strangulated forked portions 14*a*. If bubbles are generated in the rear portion of the ink passageway 14, these bubbles are forced through the strangulated portions 14*a* and will disappear.

As shown in FIGS. 4 and 5, the respective side surfaces 11*a* of the head element body 11 are provided with protrusions 19*a*, 19*b*, 19*c* at suitable portions thereof. As a result, when the plurality of printhead elements 1 are assembled, the respective protrusions 19*a*, 19*b*, 19*c* of head element bodies 11 adjacent to each other are brought into abutment so that a predetermined spacing is formed between the side surfaces 11*a* of the adjacent head element bodies 11.

Figure 7:
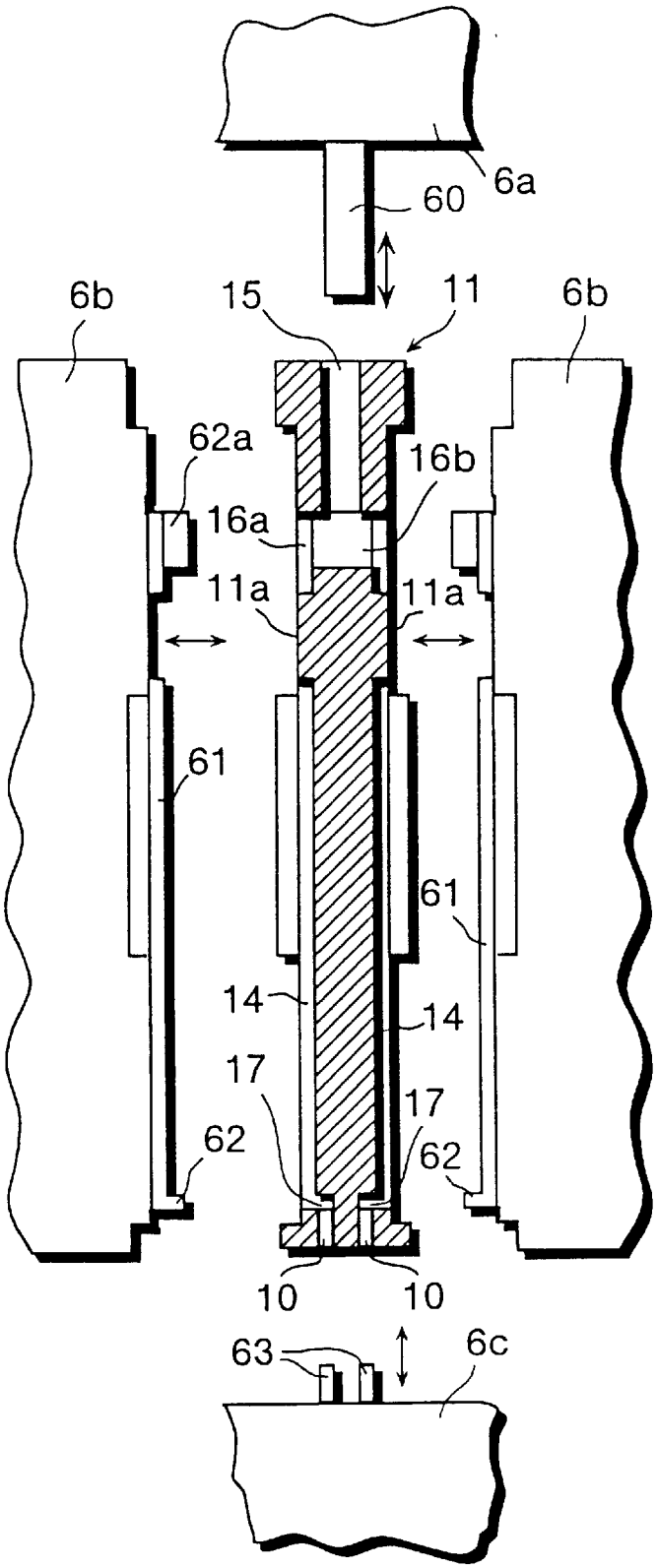
FIG. 7 illustrates an example of manufacturing process for the head element body shown in FIG. 4.

Each head element body 11 can be produced by using dies capable of pressing in the four directions for example, as shown in FIG. 7. In this, the ink injecting holes 10, the ink passageways 14 and the ink inlet 15 can be simultaneously formed to communicate with each other. Specifically, the illustrated dies include an upper die member 6*a* having a pin 60 to form the ink inlet 15, a pair of side die members 6*b* each having projections 61, 62, 62*a* to form the ink passageways 14, the groove 16*a*, the traverse port 16*b* and the step portions 17, and a lower die member 6*c* having a plurality of pins 63 to form the ink injecting holes 10.

In shaping a resin material by using the dies having the above arrangement, the ink injecting holes 10 communicating with the respective ink passageways 14 can be formed by bringing the pins 63 of the lower die member 6*c* into abutment with the projections 62 of the side die members 6*b* which form the step portions 17. The ink inlet 15 communicating with the respective ink passageways 14 can be formed by bringing the pin 60 of the upper die member 6*a* into abutment with the projections 62*a* of the side die members 6*b*. Thus, there is no need to bore the ink injecting holes and the ink inlet 15 by a separate operation after formation of the head element body 11, so that the head element body 11 is easily produced.

Figure 8:
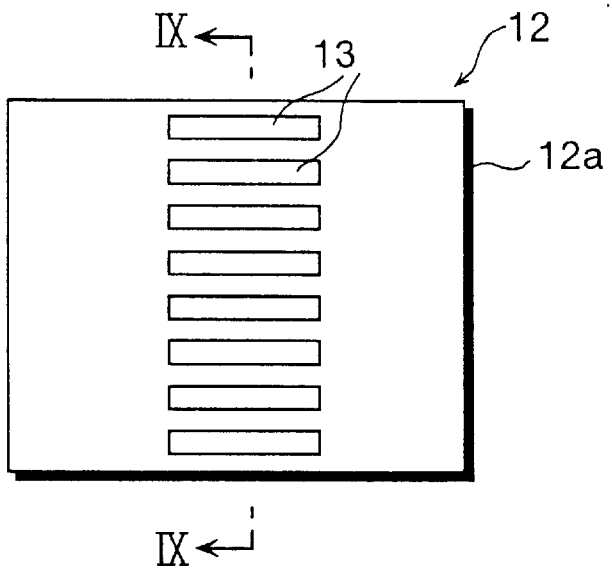
FIG. 8 is a side view showing a diaphragm attached to the head element body shown in FIG. 4.
Figure 9:
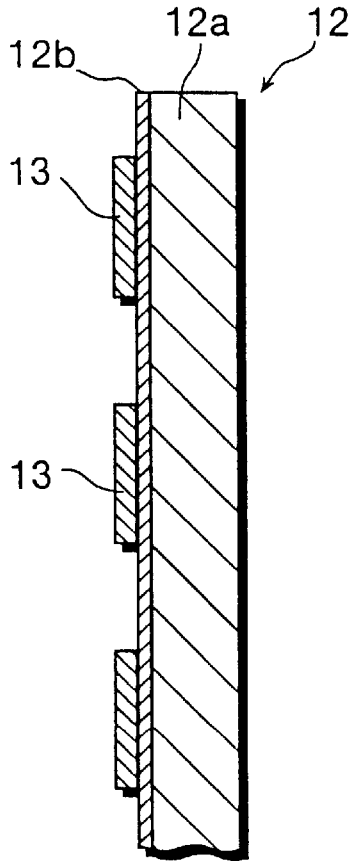
FIG. 9 is an enlarged sectional view taken along lines I—I in FIG. 8.

As shown in FIGS. 8 and 9, each diaphragm 12 includes a flexible thin plate 12*a* made of a synthetic resin material on which a transparent conductive layer 12*b* is formed, such as a tin oxide layer containing a small amount of additives or an indium oxide layer containing tin oxide (ITO layer). A plurality of piezoelectric elements are mounted directly on the layer. The plurality of piezoelectric elements 13 are deformed when they are subjected to an electric potential. With this deformation, the diaphragm 12 carrying the piezoelectric elements 13 is partially deformed into a concave state.

It is also possible to make the diaphragm 12 by using a thin glass plate instead of a synthetic resin material. The piezoelectric elements 13 supported by the diaphragm 12 via the conductive layer 12*b* are arranged to positionally correspond to the ink passageways 14 formed in the respective side surfaces 11*a*, 11*b* of the head element body 11.

The diaphragm 12 carrying the piezoelectric elements 13 is attached, by an adhesive or by using an ultrasonic bonding method, to a corresponding side surface 11*a* or 11*b* of the head element body 11 illustrated in FIGS. 4 and 5. As a result, the ink passageways 14, the groove 16*a*, the transverse port 16*b* and the step portions 17 are closed to provide a completed printhead element 1. Thus, in each printhead element 1, when the diaphragm 12 is deformed inward toward the ink passageways 14, while the ink passageways 14 are filled with ink, the volume of the ink passageway 14 is reduced to inject the ink from the ink injecting hole 10.

The piezoelectric elements 13 may be attached to the conductive layer 12*a* on the diaphragm 12 by a method similar to chip bonding, after the diaphragm 12 is attached to a corresponding side surface 11*a* or 11*b* of the head element body 11.

Figure 10:
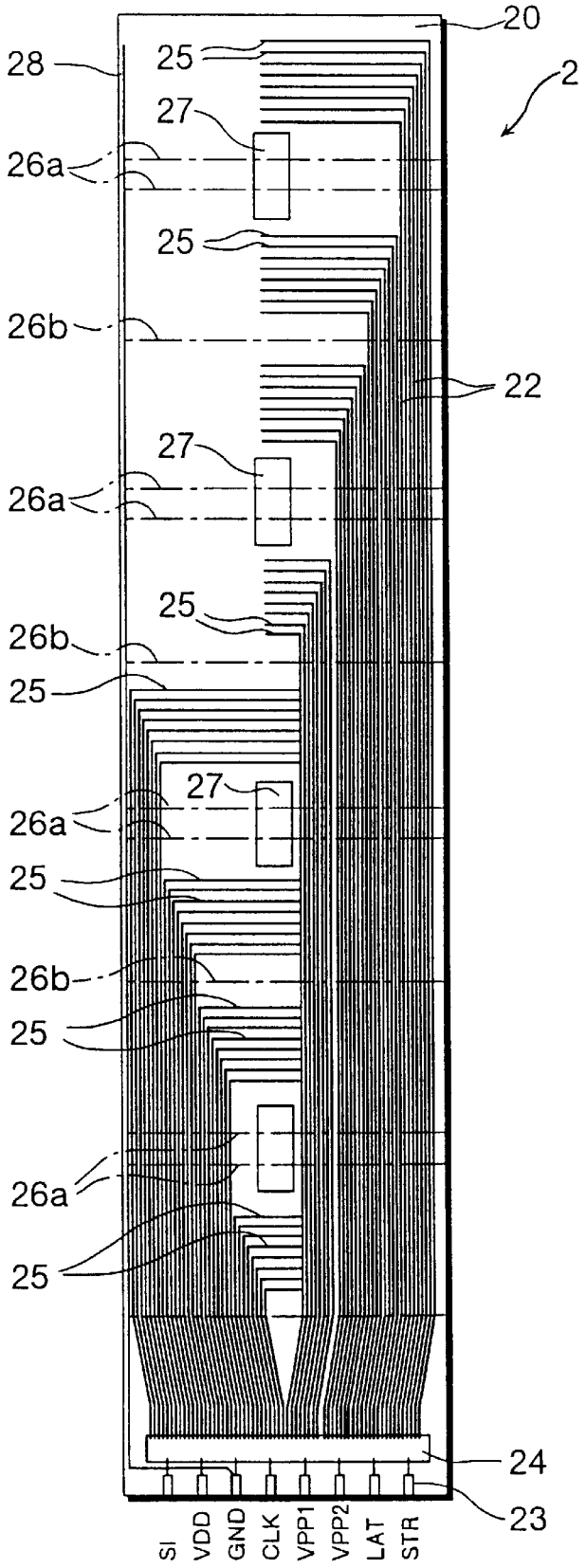
FIG. 10 is a plan view showing a flexible cord used for the ink jet printhead shown in FIG. 1.

FIG. 10 is a plan view showing the flexible cord 2 in an extended state. The flexible cord 2 is made by forming a conductive wiring pattern 22 on a surface of a flexible sheet 20 of a flat, thin synthetic resin material such as polyimide. The conductive wiring pattern 22 may be made by etching a conductive layer of e.g. copper formed on the flexible conductive sheet 20.

The conductive wiring pattern 22 is covered by an insulating layer (not shown) except some portions used for electrical connection.

The flexible cord 2 provides driving power for the plurality of piezoelectric elements 13 of the respective printhead elements 1. For this purpose, a longitudinal end of the flexible cord 2 is provided with input terminals 23 for receiving various input signals, and a drive IC 24 connected to these terminals. Further, the conductive wiring pattern 22 includes a plurality of grouped output terminals 25. These output terminals 25 in groups are brought into contact with the piezoelectric elements 13 of the respective printhead elements 1.

In an assembled state of the printhead, as shown in FIGS. 2 and 3, the flexible cord 2 is folded in a manner that alternately provides valley-shaped portions 26*a* and mountain-shaped portions 26*b* longitudinally of the cord. The grouped output terminals 25 of the conductive wiring pattern 22 are arranged on both sides of a corresponding mountain-shaped portion 26*b* and brought into facing relation with corresponding piezoelectric elements 13. As shown in FIG. 3, the valley-shaped portions 26*a* of the flexible cord 2 are externally provided on the bottom surfaces of the respective printhead elements 1, while the overlapping regions of the respective mountain-shaped portions are inserted between the plurality of printhead elements 1.

The printhead elements 1 holding the flexible cord 2 therebetween are to be laminated so that their front wall portions 1*a* are substantially contained in a common plane. Further, thus laminated printhead elements 1 are clamped as a single unit from the both sides by a pair of clamp members 3*a*, 3*b*. These clamp members 3*a*, 3*b* may be mutually connected by bolts (not shown) for example. However, in the present invention, the printhead elements 1 may be attached to each other by an adhesive for example.

Figure 11:
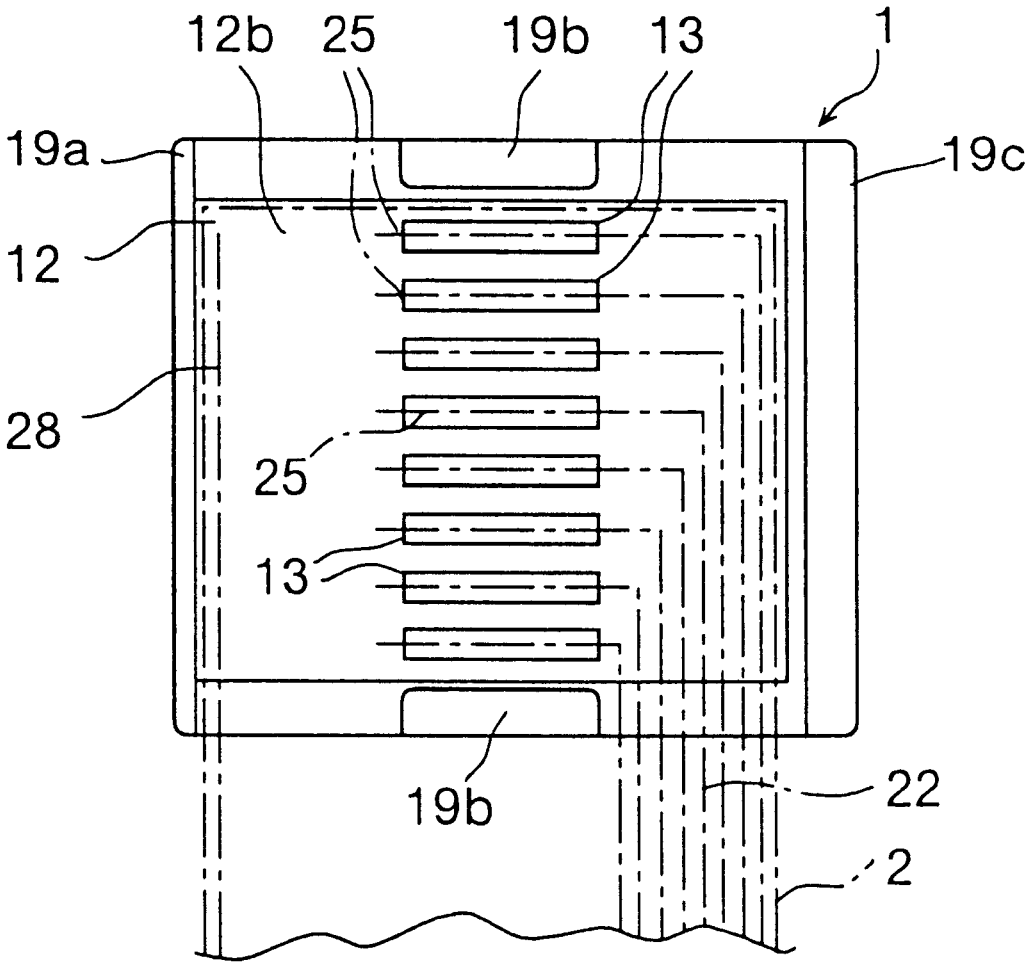
FIG. 11 is a plan view showing the printhead element of FIG. 4 and the flexible cord of FIG. 10 in a connected state.

In the flexible cord 2 held between the printhead elements 1 in a above-described manner, each group of the output terminals 25 of the conductive wiring pattern 22 is rendered to face the piezoelectric elements 13 on the side surface 11*a* of each printhead element 1. As shown in FIG. 11, each terminal 25 is connected to a corresponding piezoelectric element 13. Further, the conductive wiring pattern 22 includes a common ground electrode 28. The common ground electrode 28 is connected the conductive layer 12*b* of each diaphragm 12.

In the present invention, it makes no difference what specific manner is adopted to hold the flexible cord 2 between the respective printhead elements 1. For example, the flexible cord 2 may be folded after each printhead element 1 is attached, via a side surface thereof, to the flexible cord 2 which is in a flat extended state. Alternatively, the flexible cord 2 previously folded in a predetermined manner may be inserted between the four printhead elements 1 mutually spaced by a predetermined distance.

As shown in FIGS. 2 and 10, in the illustrated embodiment, the flexible cord 2 is formed with openings 27 spaced by a suitable distance for receiving the protrusions 19*b* of the respective printhead elements 1. With such an arrangement, it is possible to prevent the flexible cord 2 from unduly bulging from the printhead elements 1. Further, as shown in FIG. 11, when the flexible cord 2 is arranged to be accommodated between the front and rear protrusions 19*a*, 19*c* of the printhead element 1, the entire size of the ink jet printhead constituted by the respective printhead elements 1 juxtaposed to each other can be prevented from unduly increasing accordingly to the overlapped portions of the flexible cord 2.

As shown in FIGS. 1 and 3, the portions of the flexible cord 2 which are provided with the drive IC 24 and the input terminals 23 may be disposed on the outside surface of the clamp member 3*b* for example so that electrical connection to the terminals 23 is readily performed.

Figure 12:
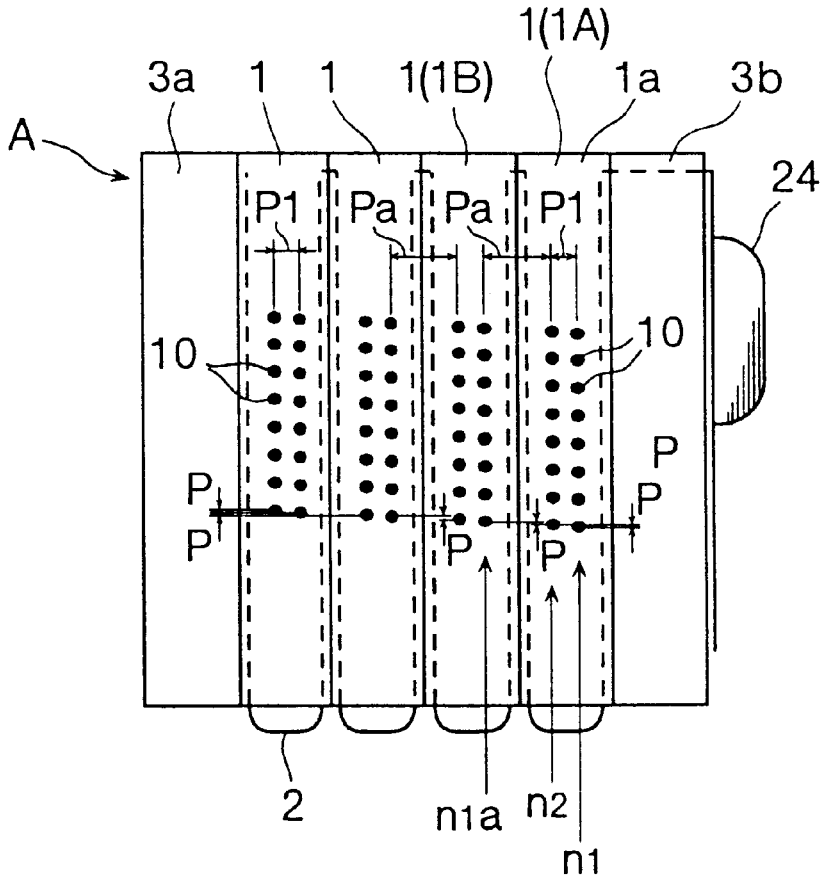
FIG. 12 is a front view showing the printhead shown in FIG. 1 except a nozzle plate.

In the printhead A thus assembled, the front wall portion 1*a* of each printhead element 1 may be formed with ink injecting holes 10 in 8 by 2 arrangement (eight holes in each row), as shown in FIG. 12, so that eight by eight ink injecting holes 10 in total are provided. It should be noted that the first row n1 and the second row n2 of ink injecting holes 10 in each printhead element 1 are vertically offset by a predetermined minimum pitch P. Further, for any two of adjacent printhead elements 1, the ink injecting holes 10 are deviated in height by the same minimum pitch P. After all, each of the totally eight rows of ink injecting holes 10 is formed to sequentially deviate in height by the predetermined minimum pitch P.

In the illustrated embodiment, for each printhead element 1 of the printhead A, the rows of ink injecting holes 10 are different in height. Alternatively, it may be possible that the first row n1 of ink injecting holes 10 and the second row n2 of ink injecting holes for each printhead element 1 are arranged to have a same height, and that the heights of the rows of different printhead elements are different when these printhead elements 1 are juxtaposed.

Further, for the printhead A according to the illustrated embodiment, the lateral pitch Pa between the second row n2 of ink injecting holes 10 of the printhead element I (1A) located first from the right and the first row n1*a* of ink injecting holes 10 of the adjacent printhead element 1 (1B) is set to be an integral multiple of (for example, twice as big as) the horizontal minimum pitch P1 between the two rows of ink injecting holes 10 in each print head element 1. Such an arrangement is realized by determining the width of the respective printhead elements 1 with reference to the minimum pitch P1.

Figure 13:
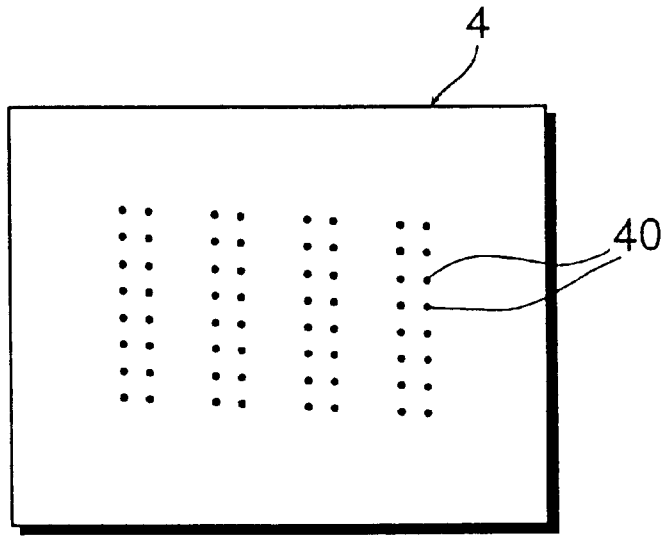
FIG. 13 is a front view showing an example of nozzle plate.

As shown in FIG. 13, the nozzle plate 4 is made of a thin plate of synthetic resin or a metal plate through which a plurality of precisely machined nozzle bores 40 extend. These nozzle bores 40 are disposed similarly to the eightby-eight ink injecting holes 10 of the printhead A, but the diameter of the bore is rendered smaller than the diameter of the ink injecting hole 10. Specifically, the ink injecting hole 10 formed by pressing with a die is rendered to have a diameter of about 0.2 mm, whereas the nozzle bore 40 of the nozzle plate 4 is rendered to have a diameter smaller than this by a laser processing method for example. The nozzle plate 4 is aligned so that the nozzle bores 40 thereof positionally correspond to the respective ink injecting holes 10 of the printhead A, and then attached to a front portion of the printhead A by using an adhesive for example.

Figure 14:
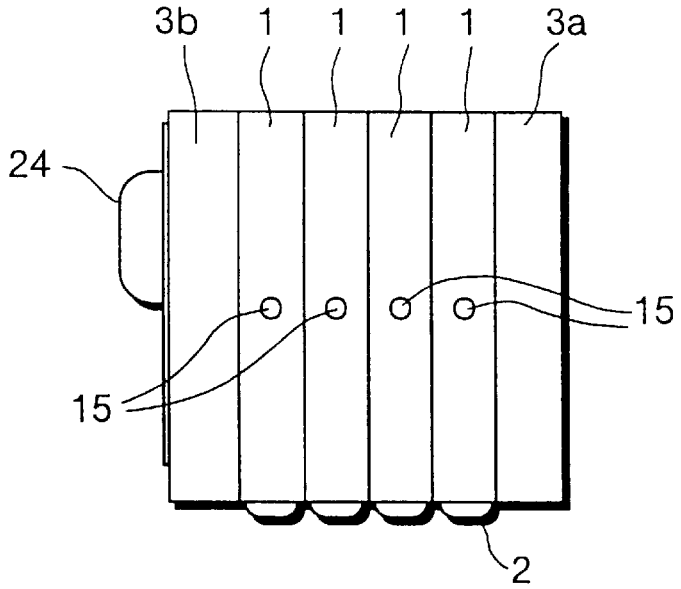
FIG. 14 is a rear view showing the printhead shown in FIG. 1 except an ink distributing member.

Further, as shown in FIGS. 1 and 2, the rear portion of the printhead A supports an ink distributing member 5 attached thereto for supplying ink for the ink inlets 15 (at four locations as shown in FIG. 14) formed in the rear wall portions 1*b* of the respective printhead elements 1. The ink distributing member 5 includes an ink supplying passageway 51, which communicates with an ink supplying pipe 50 extending backward from the rear portion of the ink distributing member. The ink supplying passageway 51 includes ramified ink distributing ports 52. The ink supplying pipe 50 is inserted into an unillustrated ink cartridge or ink tank. The ink distributing member 5 is attached to the rear portion of the printhead A so that ink is supplied into the ink inlets 15 of the printhead elements 1, after the ink is sucked and led to the ink distributing ports 52 from the ink supplying pipe 50. The above attachment provides a completed ink jet printhead as illustrated in FIG. 1. It is not necessary for the ink distributing member 5 to have a mechanism for actively sucking ink.

In use, the ink jet printhead having the above arrangement is arranged to face a platen roller of an ink jet printer for example. For this, all which is needed is to connect predetermined wiring cords to the input terminals 23 of the flexible cord 2 for performing electrical connection, but a separate wiring connecting operation is not needed for each printhead element 1. Thus, the wiring operation is remarkably simplified. Further, since only one wiring cord is to be connected to each input terminal 23 of the flexible cord 2, it is possible to avoid a disorderly state where many cords are entangled about the ink jet printhead.

Since the above-described ink jet printhead includes a plurality of printhead elements 1 in lamination, a great number of printing dots are usable. Thus, it is possible to enlarge a printed area for one actuation so that, for example, two letters or two lines of letters may be simultaneously printed by one output. On the other hand, since the flexible cord 2 is folded between the plurality of printhead elements 1, the entire width of the ink jet printhead is advantageously prevented from becoming large, thereby giving no obstacle to the downsizing of the apparatus.

In driving the ink jet printhead, the ink to be injected from the ink injecting holes 10 of each printhead element 1 is caused to flow through the nozzle bores 40 of the nozzle plate 4 disposed in front of the printhead elements and then injected to a desired printing medium. With such an arrangement, even if the ink injecting holes 10 are formed to have a rather large diameter, the ink injecting is substantially controlled by the diameter of the nozzle bores 40 of the nozzle plate 4. Thus, it is possible to set the size of the printing dots at a desired small value. Further, even if the ink injecting holes 10 is disposed with a small deviation, it is possible to adjust the deviation by the arrangement of the nozzle bores 40 of the nozzle holes 40, thereby accurately setting the position of each printing dot.

The ink injecting holes 10 and the nozzle bores 40 are sequentially offset in height every minimum pitch P, as already described with reference to FIGS. 12 and 13. Therefore, it is possible to remarkably increase the density of the printing dots as viewed vertically, thereby providing minute outputs of printing images. Further, since the lateral pitch is set at the predetermined minimum pitch P1 or a pitch Pa which is an integral multiple of the pitch P1, the driving control for adjusting printing images can be easily performed in using all of the ink injecting holes 10 to make printing images.

In the above embodiment, since the ink sucked via the ink distributing member 5 is supplied to each of the plural printhead elements 1, the entire arrangement is advantageously simplified and miniaturized in comparison with an arrangement that requires each printhead element 1 to separately be supplied with ink. However, the present invention is not limited to the above embodiment, but is applicable for making a color ink jet printhead, wherein several colors such as cyanogen, magenta, yellow and black may be separately provided for a plurality of printhead elements 1. When the plurality of printhead elements 1 are allotted for different colors as described above, it is not necessary to arrange that the ink injecting holes 10 at different heights in the respective printhead elements 1.

According to the present invention, the number of the printhead elements 1 incorporated in a single ink jet printhead is not limited to four like the above embodiment, and the configuration of each printhead element 1 is not limited to that of the embodiment. Further, the number and the disposition of the ink injecting holes 10 formed in the front wall portion 1*a* of the printhead element 1 are not limited. Further, there is no need to mount the piezoelectric elements 13 on both side surfaces of the printhead element 1, but only one of them may be provided with piezoelectric elements 13.

Further, in the above embodiment, a single flexible cord 2 is folded between the juxtaposed printhead elements 1. However, it is also possible to prepare a plurality of flat flexible cords each carrying output terminals on its both surfaces so that each cord is inserted between the printhead elements 1 for electrical connection.

Figure 15:
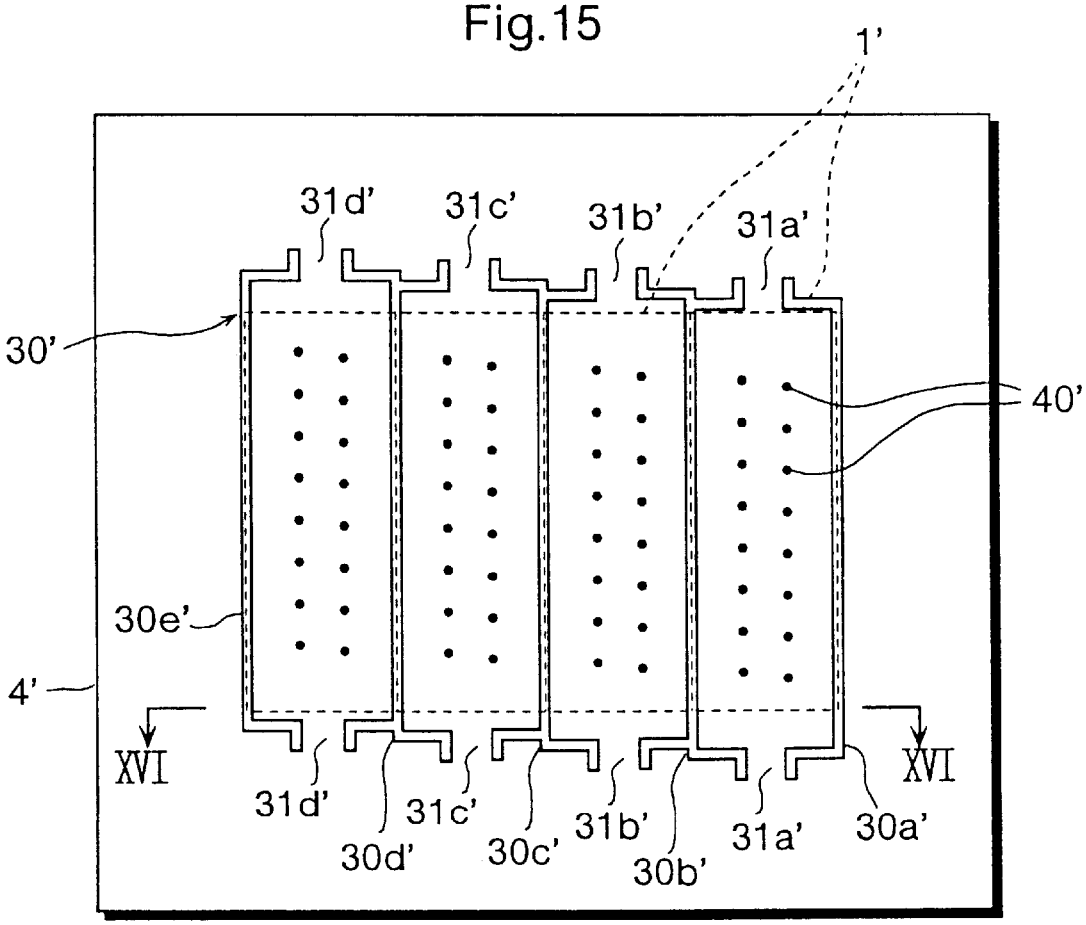
FIG. 15 is a front view showing another example of nozzle plate.
Figure 16A:
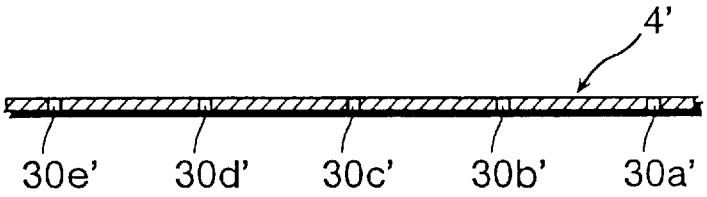
FIG. 16*a* is a sectional view taken along lines XVI—XVI in FIG. 15.

FIGS. 15 and 16*a* show a nozzle plate 4' used for an ink jet printhead according to a second embodiment of the present invention. The nozzle plate 4' is characterized in having a plurality of slits 30' as deviation absorbing means. The slits 30' include five slits 30*a*'–30*e*' defining four regions in a central portion of the nozzle plate 4'. Uncontinuous portions 31*a*'–31*d*' are provided between the respective slits. Since the nozzle plate 4' is a thin plate, each of the thus defined regions can slightly deflect perpendicularly to a plane of the nozzle plate 4' via the uncontinuous portions 31*a*'–31*d*'. Each region is formed with two rows of nozzle bores 40'. Reference sign 1' indicates mutually laminated four printhead elements which correspond to the respective regions as defined above.

The slits 30' as deviation absorbing means according to the second embodiment have a technical significance as follows. That is, when the printhead elements 1' are juxtaposed, it is ideal that their front wall portions (see the element 1*a* in FIG. 2) are arranged as if contained in a common plane. However, it is not easy to accurately achieve this. Therefore, upon assembly, the front wall portion of each printhead element 1' may deviate slightly relative to each other perpendicularly to the plane of the nozzle plate 4'. However, according to the present invention, since the defined regions of the nozzle plate 4' corresponding to the respective printhead elements 1' are capable of deforming independently of each other via the uncontinuous portions 31*a*'–31*d*', the above deviation can be absorbed so that the front wall portions of all the printhead elements 1' are closely engaged by the corresponding defined regions. As a result, there is no need to perform an exact position setting to laminate the printhead elements 1', thereby facilitating the assembly operation.

The configuration of the slits 30' as deviation absorbing means is not limited to that illustrated in FIG. 15. In short, it suffices that formation of the slits 30' allows each defined region of the nozzle plate 4' to deflect perpendicularly to the plane of the nozzle plate 4'. Therefore, the configuration and width of the slits 30' as well as the width of the uncontinuous portions 31*a*'–31*d*' can be suitably varied as required. Further, apparently the number of the slits 30' can be altered correspondingly to the number of the printhead elements 1' incorporated in the ink jet printhead.

Figure 16B:
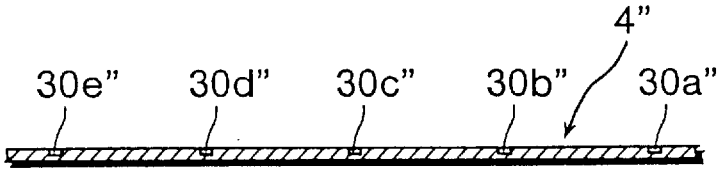
FIG. 16*b* shows another example of nozzle plate in section similar to FIG. 16*a*.
Figure 17:
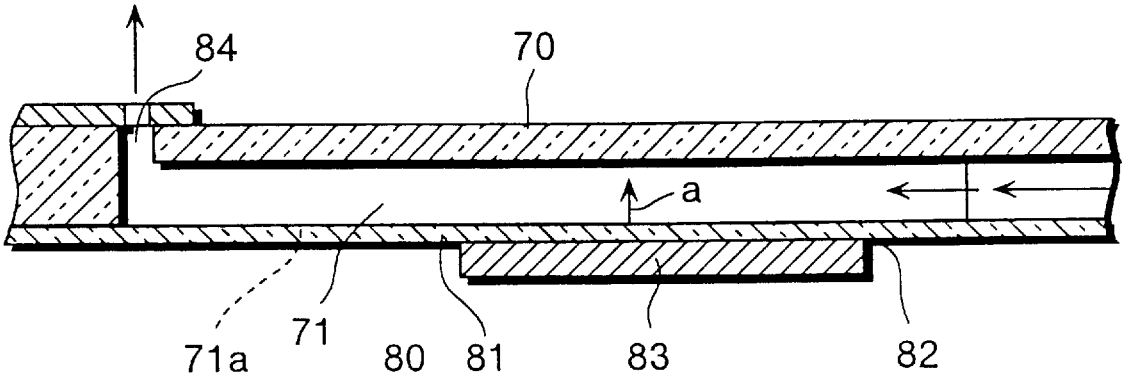
Fig.17 Prior Art
FIG. 17 is a sectional view showing the arrangement of a prior art ink jet printhead.

Further, as shown in FIG. 16*b*, it is also possible to use a nozzle plate 4" which is formed with grooves 30*a*"–30*e*" instead of the slits. In this instance, each groove may be formed by partially etching predetermined portions of the nozzle plate 4". Further, since each groove does not penetrate the nozzle plate 4", the groove may continuously surround a corresponding region.

The grooves 30*a*"–30*e*" (FIG. 16*b*) are advantageously used instead of the slits 30*a*'–30*e*' (FIGS. 15 and 16*a*). For example, upon injecting ink from the nozzle bores, even when some of it may stick near the bores and accumulate, the accumulated ink is properly prevented from flowing onto the printhead elements. However, the deviation absorbing performance provided by the groove 30*a*"–30*e*" is less in quality than that provided by the slits 30*a*'–30*e*". Therefore, which to utilize should be selected depending on the type and applications of an ink jet printhead.

I claim:

1. An ink jet printhead comprising a plurality of printhead elements each having a plurality of ink injecting holes, a flat flexible cord electrically connected to the plurality of printhead elements, and an ink supplier for supplying the plurality of printhead elements with ink, wherein each printhead element includes a front wall provided with the plurality of ink injecting holes, said each printhead element also including a side wall formed with a plurality of grooved ink passageways communicating with the plurality of ink injecting holes, said each printhead element further including a diaphragm attached to the side wall of the printhead element and carrying a plurality of piezoelectric elements in corresponding relation to the plurality of ink passageways, wherein the plurality of printhead elements are laminated on each other with the front walls thereof oriented in a same direction, wherein the flexible cord includes a flexible sheet and a conductive wiring pattern formed on the flexible sheet, the conductive wiring pattern having output terminals electrically connected to the piezoelectric elements of the printhead elements, and wherein the flexible sheet together with the wiring pattern is alternately folded in opposite directions and inserted at every other folded portion between adjacent printhead elements.

2. The ink jet printhead according to claim 1, wherein each ink passageway of said each printhead element has a front end formed with a step portion which is deeper than the ink passageway, said each ink passageway communicating with a corresponding ink injecting hole via the step portion.

3. The ink jet printhead according to claim 1, wherein each ink passageway of said each printhead element has a rear end formed with a projection for partially constricting said each ink passageway.

4. The ink jet printhead according to claim 1, wherein said each printhead element has a rear wall provided with an ink inlet communicating with the ink passageways of said each printhead element.

5. The ink jet printhead according to claim 4, wherein the ink supplier is attached to the rear wall of said each printhead element and serves as an ink distributing member having branching passages each communicating with the ink inlet of said each printhead element.

6. The ink jet printhead according to claim 1, wherein the ink injecting holes of said each printhead element are arranged in at least one row, the row of ink injecting holes in said each printhead element being offset in a direction of the row by a predetermined pitch relative to the row of ink injecting holes in an adjacent printhead element.

7. The ink jet printhead according to claim 1, wherein the ink injecting holes of said each printhead element are arranged in two parallel rows, the two rows of ink injecting holes in said each printhead element are offset relative to each other in a direction of the rows by a predetermined pitch.

8. The ink jet printhead according to claim 1, wherein the ink injecting holes in said each printhead element are formed separately into a first row of ink injecting holes and a second row of ink injecting holes, the first and second rows in said each printhead element being spaced from each other by a minimum pitch, the second row of ink injecting holes in said each printhead element is spaced from the first row of ink injecting holes in an adjacent printhead element by a pitch which is an integral multiple of the minimum pitch.

9. The ink jet printhead according to claim 1, wherein a nozzle plate is commonly attached to the front walls of the printhead elements, the nozzle plate being formed with minute nozzle holes in corresponding relation to the ink injecting holes of the printhead elements.

10. The ink jet printhead according to claim 9, wherein the nozzle plate includes a deviation absorber for dividing the nozzle plate into a plurality of regions corresponding to the printhead elements, the divided regions of the nozzle plate being independently movable perpendicularly to a surface of the nozzle plate.

11. The ink jet printhead according to claim 10, wherein the deviation absorber comprises slits for discontinuously surrounding the divided regions of the nozzle plate.

12. The ink jet printhead according to claim 10, wherein the deviation absorber comprises grooves for substantially surrounding the divided regions of the nozzle plate.

13. A nozzle plate for an ink jet printhead which includes a plurality of printhead elements in lamination, each printhead element having a front wall provided with a plurality of ink injecting holes, the nozzle plate being commonly attached to the front wall of the printhead elements, wherein the nozzle plate comprises slits for dividing the nozzle plate into a plurality of regions corresponding to the printhead element, the slits discontinuously surrounding the divided regions of the nozzle plate, the divided regions of the nozzle plate being independently movable perpendicularly to a surface of the nozzle plate.

14. A nozzle plate for an ink jet printhead which includes a plurality of printhead elements in lamination, each printhead element having a front wall provided with a plurality of ink injecting holes, the nozzle plate being commonly attached to the front wall of the printhead elements, wherein the nozzle plate comprises grooves for dividing the nozzle plate into a plurality of regions corresponding to the printhead elements, the grooves substantially surrounding the divided regions of the nozzle plate, the divided regions of the nozzle plates being independently movable perpendicularly to a surface of the nozzle plate.

* * * * *